US005690169A

United States Patent [19]

Foerster

[11] Patent Number: 5,690,169

[45] Date of Patent: Nov. 25, 1997

[54] HEAT TRANSMITTING APPARATUS

[76] Inventor: Hans Foerster, Beimstrasse 59, D-39110 Magdeburg, Germany

[21] Appl. No.: 603,213

[22] Filed: Feb. 20, 1996

[30] Foreign Application Priority Data

Feb. 20, 1995 [DE] Germany ..... 195 05 746.5

[51] Int. Cl.[6] ..... F28F 9/22

[52] U.S. Cl. ..... 165/160; 165/159; 165/DIG. 406

[58] Field of Search ..... 165/159, 160, 165/161, 158

[56] References Cited

U.S. PATENT DOCUMENTS

| | | | |
|---|---|---|---|
| 1,469,193 | 9/1923 | Sims | 165/161 |
| 4,858,681 | 8/1989 | Sulzberger | 165/158 X |

FOREIGN PATENT DOCUMENTS

| | | | |
|---|---|---|---|
| 1586954 | 3/1970 | France | 165/161 |
| 668647 | 12/1938 | Germany | 165/160 |
| 218167 | 1/1985 | Germany . | |
| 4102293 | 8/1991 | Germany . | |
| 4102294 | 8/1991 | Germany . | |
| 441145 | 10/1948 | Italy | 165/159 |
| 505127 | 5/1939 | United Kingdom | 165/160 |
| 865997 | 4/1961 | United Kingdom | 165/160 |
| 2224821 | 5/1990 | United Kingdom | 165/159 |

*Primary Examiner*—Leonard R. Leo
*Attorney, Agent, or Firm*—Karl Hormann

[57] ABSTRACT

The invention relates to an apparatus for exchanging heat between a small volumetric flow liquid medium and a large volumetric gaseous medium and provides for a plurality of radially disposed and interconnected concentric annular flow channels for the gaseous medium and a plurality of pipes extending axially through said annular flow channels providing flow passages for the liquid medium, said annular flow channels being preferably formed by successive convolutions of a heat insulating web.

7 Claims, 2 Drawing Sheets

HEAT TRANSMITTING APPARATUS

BACKGROUND OF THE INVENTION

1. Field of the Invention

The invention, in general, relates to heat transmitting or exchanging apparatus and, more particularly, to a heat exchanger of the kind useful for small liquid flows and large gas or vapor flows and provided with an external case as a pressure housing and preferably equipped with straight tubing provided with external fins or vanes providing for lateral flows and cross-counter-current guidance of the heat exchange currents. Such heat exchangers may be useful, for instance, for heating air and technical gasses, including the utilization of the coldness component of gas and or vapor flows, for utilizing waste heat flows at low temperature differences under counter current conditions, and for cooling liquids by cold air or refrigerant vapors. The gas or vapor phase will hereinafter be referred to from time to time as gaseous phase.

2. The Prior Art

A heat exchanger is known from German (G.D.R.) Patent DD 218,167 in which input and output of the gas or vapor phase occur in a divided central pipe having no connections in its cylindrical outer housing, there being inserted in the central pipe a thermal insulation wall. This arrangement provides for an intersecting counter flow between the liquid volume flow and a very large gas or vapor volume flow, with the gas or vapor volume flow flowing through an annular channel at 0°–360° in a single current or in two currents at 0°–180° each after which it is extracted again at the output end of the central pipe. In this structure, the finned pipes are disposed exactly transversely of the gas or vapor flow and provide for multiple flows paths at the liquid side with an intersection counter current guidance of the heat exchanging media. This principle or structure depends for it proper functioning on very large gas or vapor quantities, however. For smaller gas or vapor quantities, it has not been possible to construct compact apparatus of great heat exchange surface density.

German patent DE 4,102,294 discloses utilizing the described heat exchange principle with a plurality pipes which, in a 2/2 flow structure and for partial condensation of condensible gas components, are parallel connected in a radial direction. There is also disclosed an embodiment provided with a floating head. Because of the radial parallel arrangement of the finned pipes and because of the 2/2 flow paths, this structure, too, is suitable for large gas or vapor volumes, i.e. for turbo compressors rather than piston compressors as stated in that patent. The same may be said about the 4,102,293 patent. It proposes very large center pipes, a floating head and the insertion of spray eliminators, with the gaseous phase being extracted by a special tunnel within the center pipe. Such a structure is not suitable for use with medium gas or vapor currents, and the flow path for the gaseous phase is short, thus limiting its use, as in the apparatus described supra, to small temperature increases or decreases of the media,

OBJECTS OF THE INVENTION

It is a general object of the invention to provide a heat exchanger for intersecting counter current guidance of the heat exchanging media.

A more specific object of the invention is to provide a heat exchanger for use with medium gas or vapor volumes and small or minute liquid volumetric flow rates.

Still another object of the invention resides in providing a heat exchanger in which large increases or decreases in the temperature of the flow media may be realized at minimum pressure losses in the gas.

It is also an object of the invention to provide a heat exchanger wherein the sizes of both pressure supporting surface and the sealing surface are kept at a minimum.

Yet another object is to provide a heat exchanger of a significantly simplified structure relative to that of conventional heat exchangers.

A still further object is to provide a heat exchanger providing for a lay-out of the flow area cross sections for the liquid phase readily adaptable to increase the density of the heat exchange surface.

Other objects will in part be obvious and will in part appear hereinafter.

BRIEF SUMMARY OF THE INVENTION

In accordance with the invention, there are provided for the flow of the gas or vapor phase concentrically arranged annular channels. These annular channels are provided with pipes which, in turn, may be provided with fins or vanes. Cylindrical sleeves made of metal, non-metallically coated metals, or non-metal materials are provided for separating individual flow paths of the gas or vapor phase. At the end of each annular channel formed by a terminal wall, the gas or vapor phase may radially move through openings in a cylindrical wall to the next adjacent annular channel, so that the gas or vapor phase will consecutively flow through all of the channels, either radially inwardly or radially outwardly, while the liquid phase is fed through the axially arranged pipes. The liquid is distributed by concentrically arranged deflection chambers provided in end spaces of the heat exchanger. The deflection chambers are preferably provided with radial wall members for grouping predetermined numbers of pipes into common flow paths thus ensuring optimal cross-counter flow conditions between heat exchanging media.

There may in each annular channel be one or more groups of pipes constituting a common flow path. As will be appreciated by persons skilled in the art, any precise structure depends upon the ratio between the volumetric flow of given gas or vapor and liquid quantities.

In a particular embodiment of the invention the separating or insulating walls of the annular channels may be formed by smooth insulating foils tightly wrapped over the pipes, rather than by rigid wall members. Such foils provide for an annular channel structure which is free of any play between the channels and heat exchange pipes. They offer improved heat exchange conditions, with at least one end of the insulating foil being clamped between rails or retainers for resilient attachment to a stationary member. Moreover, such an arrangement of wrapped foil provides for transitions between the annular channels which are substantially free of pressure losses and which do not require individual separation walls.

BRIEF DESCRIPTION OF THE DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DETAILED DESCRIPTION OF PREFERRED EMBODIMENTS

Figure 1:
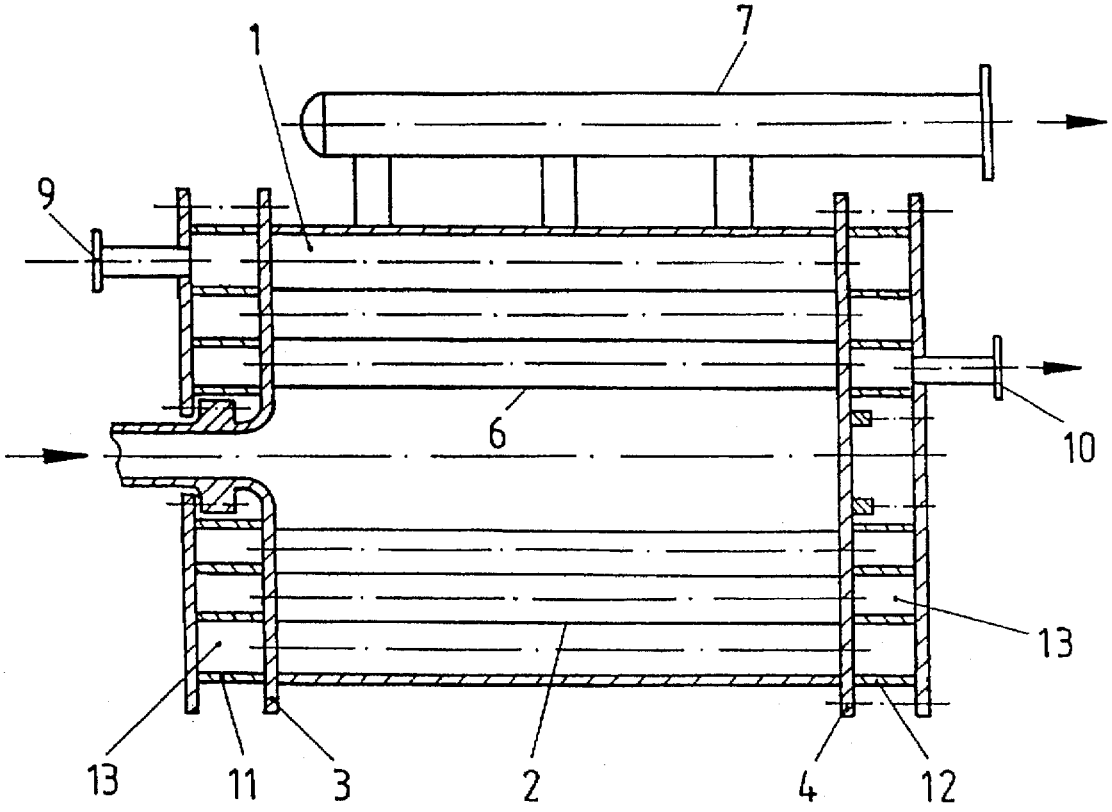
FIG. 1 is a longitudinal section through a heat exchanger in accordance with the invention provided with three concentrically arranged annular channels.
Figure 2:
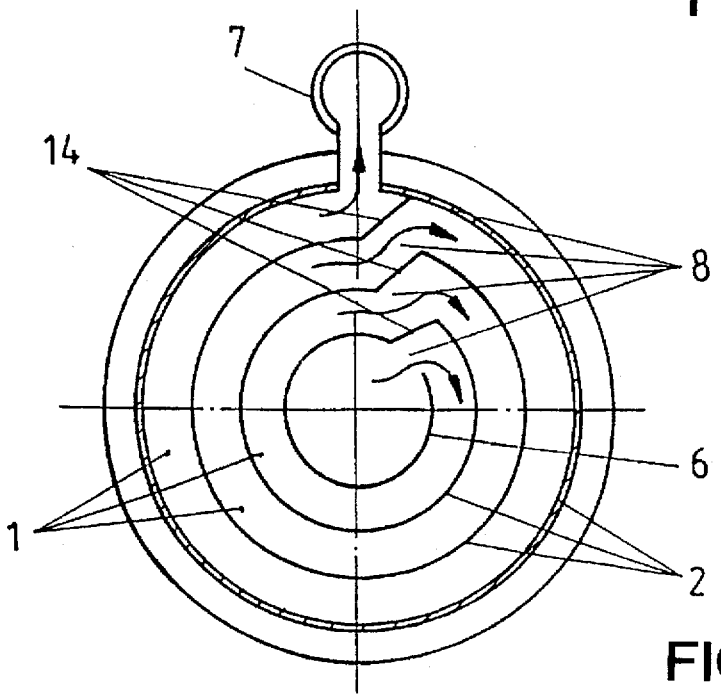
FIG. 2 is a cross-section through that part of a heat exchanger in accordance with the invention through which the gas or vapor phase is flowing unidirectionally in the annular channel.
Figure 3:
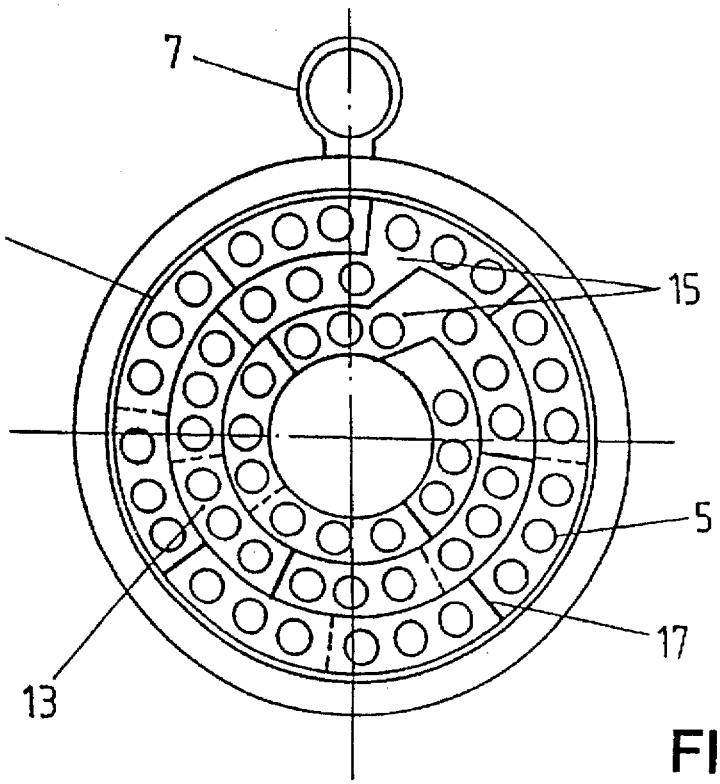
FIG. 3 is a sectional view of the terminal chamber of a heat exchanger in accordance with the invention having three concentrically arranged annular channels with three pipes being grouped together into a common flue for a liquid.
Figure 4:
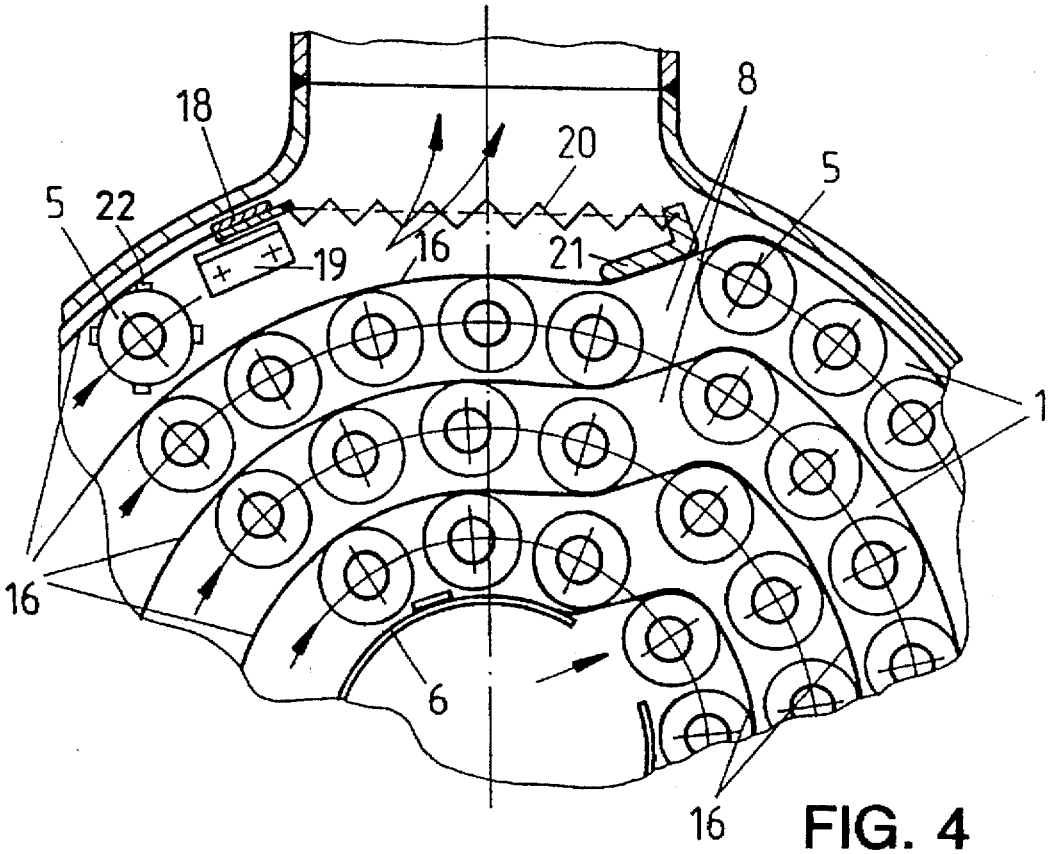
FIG. 4 depicts a mounting of the outer end of a separation foil and gas flow patterns when separation or insulating foils are used.

With reference to the drawings, a heat exchanger in accordance with the invention will be seen to be provided with internested concentrically arranged annular channels 1. The annular channels 1 are formed by a center pipe 6 and convoluting substantially cylindrical walls 2 or separating or insulating foils 16 concentrically disposed between two end plates 3 and 4. As stated supra, the walls 2 or foils 16 may be webs made from metal, metals coated with non-metallic, such as ceramic or polymeric material, or of similar non-metallic materials, and, preferably, they are thermally insulating. Pipes 5 arranged substantially circularly are mounted in each of the channels 1 and extend axially therein. The pipes 5 are preferably provided with external fins or vanes 22 as schematically and exemplarily shown on one of the pipes 5 in FIG. 4. A gaseous or vaporized medium, which represents the higher volumetric flow, preferably enters through the center pipe 6 and exits by way of a collector 7. At the end of the annular channel 1 each concentrically arranged cylindrical wall 2 is provided with one or more openings 8 connecting it with the next adjacent annular channel. Through the openings 8, the gaseous phase present at the exterior of the fin or vane pipes 5 transits to the next adjacent annular channel 1 whenever an annular chamber has been substantially absorbed by or filled with the medium. Where an insulating foil 16 is used, it is wrapped, preferably continuously, from one annular channel to another, over the enlarged outer surfaces (fins, vanes) of the pipes 5. At the transition between adjacent channels, the pipes 5, with each separating or insulating wall 14, form terminal channel sections and, hence, the openings 8.

To place the foil 16 against the pipes 5 without forming any creases, the end of the foil 16 is retained by an elongate tensioning device 18 slidably positioned upon guide brackets 19 and maintained under resilient tension by springs 20. The elongate tensioning device 21 serves as an anchoring point for the spring 20 as well as for guiding the foil 16.

The liquid phase (small volumetric flow) is fed into a connection 9 and is withdrawn through a connection 10 as a cross or counter current to the gas or vapor phase within the annular channels 1. Additional connections (not shown) may be provided between the connections 9 and 10 to feed and withdraw partial liquid flows depending on their temperature level. Spaces 11 and 12 constitute concentrically arranged deflection chambers. Radially extending walls 17 are provided within the annular channels 1 to group predetermined numbers of pipes 5 into flow paths so that the liquid phase between the deflection chambers 13 flows axially through the pipes 5 and is thus guided step-by-step as a cross-counter current to the gas or vapor phase within the annular channels 1. At the end of the concentric deflection chambers 13 of the spaces 11 and 12 the liquid phase flows either radially through openings 15 to an adjacent concentric deflection chamber 13 or to the exterior through the connection 10. The deflection chambers 13 are formed by randomly placed radial wall members 17. There is no limitation in either the number of annular channels 1 or pipes 5.

VARIOUS ADVANTAGES OF THE INVENTION

The concentric and internesting arrangement of a plurality of annular channels and their alignment relative to a center pipe yields a compact structure as well as a high density of the heat exchanging surfaces. If after heat transfer the temperature of the media is close to the ambient temperature and if the inlet or outlet of the media is near the exterior circumference of the heat exchanger in accordance with the invention, there is either no need for any thermal insulation or it may be minimized. A circular structure of the heat exchanger allows for excellent sealing between the heat exchanger and the environment, so that the heat transfer between hazardous substances can be realized. A cylindrical configuration makes it possible to construct thin-walled apparatus which are nevertheless suitable for higher pressures within the annular channels and the pipes. A cross-counter flow between the heat transferring media and an exact transverse flow relative to the fins or vanes of the pipes is obtained by selecting the arrangement of the pipes relative to the openings in the cylinder walls. By the use of smooth insulating foils pressure losses within the annular channel can be minimized, particularly since it provides for rounded, rather than cornered gas transit points between the annular channels. At the same time, individual openings in the cylindrical walls are no longer necessary, because the bridging provided by the insulating foil between one annular channel to another, the entire gap is available for the gas phase. An important advantage resulting from the use of an insulating foil instead of rigid cylindrical walls is the engagement of the foil with the outer contour of the pipe. In this manner the flow is forced against the enlarged outer surfaces of the pipes (fins, vanes) which, in turn, yields an improved heat transfer. Last but not least, the use of such insulating foils instead of rigid cylindrical walls leads to advantages in terms of economy and manufacturing techniques. Also, compactness and mass or weight of the apparatus is reduced.

As used herein, gaseous is intended to include any non-solid and liquid substances or mixtures thereof, and phase and medium, both in the singular and plural forms, are intended to be understood as synonyms.

It will be understood by those skilled in the art that certain changes and modifications may be made in any of the embodiments herein described, without departing from the scope or spirit of the invention. It is, therefore, intended that all matter herein described and shown is to be interpreted as being exemplary only, and in no way limiting the scope of protection sought.

What is claimed is:

1. An apparatus for exchanging heat between small liquid volume flows and large gaseous volume flows, comprising:

means for forming a circularly cylindrical pressure chamber of a predetermined length comprising a side wall defining radially directed gaseous flow output means and first and second end wall means;

pipe means coaxially aligned within said pressure chamber and extending from one of said first and second end wall means to the other of said end wall means, said pipe means having an axial gaseous flow input aperture and an elongate radially disposed gaseous flow aperture into said pressure chamber;

means forming first and second enclosed deflection chambers at said first and second end wall means and respectively provided with liquid flow input and output means;

a plurality of liquid flow tubular members extending between said first and second deflection chambers through said pressure chamber in a concentric arrangement around said pipe means and provided on their exterior with heat dissipating means;

substantially smooth thermally insulating web means extending in a convoluted path from said pipe means toward said side surface for forming a plurality of substantially annular chambers circumscribing said pipe means for receiving said tubular members and providing unidirectional gas flow thereacross between said gaseous flow aperture and said gaseous flow output means, said web means being of a width substantially equal to said predetermined length; and means for drawing said web means into taut tangential contact with said tubular members.

2. The apparatus of claim 1, wherein said tubular members are arranged in more than one circular arrangement and wherein said web means comprises a plurality of convolutions each having a flaring section leading from one circular arrangement to a next adjacent circular arrangement.

3. The apparatus of claim 2, wherein said web means is made of metal.

4. The apparatus of claim 2, wherein said web means is made of a non-metallically coated metal.

5. The apparatus of claim 2, wherein said web means is made of a non-metallic material.

6. The apparatus of claim 2, wherein said deflection chambers are divided into annular chambers aligned coaxially with said circular arrangement of said tubular members and wherein radially extending wall members are provided in said annular chambers for dividing said channels annular chambers into annular sectors with at least one tubular member aligned with each of said sectors.

7. The apparatus of claim 2, wherein said means for drawing comprises tension spring means connected to the end of said web means adjacent said side wall and a peripheral portion of said web means.

* * * * *